United States Patent [19]

Kessler

[11] Patent Number: 4,691,487

[45] Date of Patent: Sep. 8, 1987

[54] DRAIN TUBE FOR WINDOWS

[76] Inventor: Gerald Kessler, 302 McClurg Rd. at Southern Blvd., Box 389, Youngstown, Ohio 44501

[21] Appl. No.: 891,346

[22] Filed: Jul. 31, 1986

[51] Int. Cl.[4] ..... E06B 7/14

[52] U.S. Cl. ..... 52/209; 98/119; 137/527.8

[58] Field of Search ..... 52/209, 302, 303, 95; 137/527.6, 527.8; 98/119, 42.09, 42.19, 42.13, 42.12

[56] References Cited

U.S. PATENT DOCUMENTS

| | | | |
|---|---|---|---|
| 1,063,637 | 6/1913 | Barker | 137/527.8 |
| 1,104,806 | 7/1914 | Kahn | 137/527.6 |
| 1,348,562 | 8/1920 | Hauser | 137/527.8 |
| 1,510,033 | 9/1924 | Bold | 137/527.6 |
| 2,093,515 | 9/1937 | Filkins | 137/527.8 |
| 2,139,991 | 12/1938 | Wingard | 98/119 |
| 2,313,488 | 3/1943 | Johanns | 52/209 |
| 2,827,674 | 3/1958 | Hauck | 52/209 |
| 3,565,099 | 2/1971 | Huber | 137/527.8 |
| 4,237,621 | 12/1980 | Boismenu | 98/119 |

FOREIGN PATENT DOCUMENTS

| | | | |
|---|---|---|---|
| 1200497 | 12/1959 | France | 52/209 |
| 35671 | 9/1922 | Norway | 52/209 |
| 454080 | 9/1936 | United Kingdom | 52/209 |

*Primary Examiner*—John E. Murtagh

*Attorney, Agent, or Firm*—Browdy and Neimark

[57] ABSTRACT

A straight drain tube for use with window assemblies includes a linear conduit having an inlet end for receiving moisture build-up and a outlet for dispensing the moisture to the outside of the window structure. The drain tube also includes closure means for sealing the conduit's outlet end, which is seated in an integrally molded closure face unitary with the conduit.

11 Claims, 3 Drawing Figures

DRAIN TUBE FOR WINDOWS

FIELD OF THE INVENTION

The present invention relates to the draining of water, especially water of condensation or rain water from window assemblies, especially the dead space between adjacent parallel windows; more particularly the invention relates to a drain tube construction which can be easily installed in a window assembly either in the factory or in the field, and which successfully drains away any moisture which condenses between the windows.

BACKGROUND OF THE INVENTION

Drain tubes or draining holes for use in conjunction with window assemblies have been well known for years. Many of these devices are usually just an elongated channel or hole previously drilled through a window assembly prior to its installation. For example, U.S. Pat. No. 364,434 to Pitman, U.S. Pat. No. 1,882,088 to O'Connor, U.S. Pat. No. 168,869 to Bradshaw and U.S. Pat. No. 2,705,819 to Gellert et al all show window assembly structures including a hole or channel drilled directly through a solid portion of the window structure to drain accumulated moisture therefrom. While the drainage means of these above-mentioned patents are beneficial for removing moisture build-up within window assemblies, the draining holes must be drilled into the window assembly prior to installation of the window structure. Also, drilling a hole or channel is effective only when the frame is solid, which does not apply to most modern window frames which are usually extruded plastic or aluminum.

U.S. Pat. No. 1,320,864 to James and U.S. Pat. No. 2,570,336 to Fouts both show drain tubes for use in conjunction with window structures which include an elongated conduit mounted within a portion of the window assembly. However, most of these types of conduits are of complex shape, i.e. not straight, making them extremely difficult to install in existing window assemblies. Moreover, curved tubes are more expensive and more difficult to install even in factories, but have nevertheless been used because of the required configuration or geometry of the window sills which make the use of a straight tube most difficult.

It is standard practice in window constructions to make the inside sill leg height greater than the outside sill height, and this is the first line of defense for preventing rain water or water of condensation from going over the inside sill leg of the window. It is this configuration or geometry which has complicated the use of drain tubes as mentioned above, and has usually required that drain tubes be curved. Although it does not relate to a window frame, the problem is illustrated in the Tibbetts U.S. Pat. No. 3,851,420 which relates to the provision of a drainage tube in an extruded threshold for a door, attention being particularly invited to FIG. 10. Because of the geometry involved, the drain tube illustrated in curved. Similarly, in a conventional extruded window frame, the geometry of the frame has usually dictated a curved tube with all its attendant problems.

An exception is illustrated in the Giger U.S. Pat. No. 3,466,819 which shows a drainage tube containing a ball check valve. However, this is a special construction which is atypical and which, moreover, uses an extruded frame provided with a groove through its upper surface for providing access to the drain tube. Such an extruded frame is undesirable for a number of reasons including poor customer acceptance, undesirable appearance, and the provision of a large opening which is likely to accumulate not only dirt and debris, but also provide a home for undesirable insects or the like.

The patent to Hauck U.S. Pat. No. 2,891,290 discloses a window drain without a tube, but which includes a baffle or closure at the outlet end. The closure or baffle will close when the wind is blowing against it from a direction substantially perpendicular to the plane of the closure. Normally, however, such a flap valve will hang in a slightly opened position. Moreover, if the wind is blowing generally parallel to the plane of the baffle, the wind will have a tendency to pull the baffle open. A flap valve is also shown in the Hester U.S. Pat. No. 1,291,511, but here it is provided as an internal structure which greatly increases the cost and complexity of its installation.

In spite of the various attempts in the prior art, the installation of drain tubes in modern extruded windows has remained a problem for many years. Because of the geometries involved, it has normally been necessary to use a curved tube and to install it at the factory from the inside out. This has not provided a satisfactory solution, and there has been a need to have a simpler drain tube construction, and one which could be installed in the field or the factory. No straight, i.e. linear, drain tube for use in conjunction especially with extruded window frames has previously been available which is capable of being easily installed in the field within existing window assemblies. Furthermore, there is a need for a straight drain tube which is provided with a reliable closure, and well as a drain tube which can be manufactured as a single unitary structure.

SUMMARY OF THE INVENTION

Accordingly, it is an object of the present invention to eliminate deficiencies of the prior art, such as those set forth above.

It is another object to provide for improved drainage of moisture from the sills of extruded window frames.

It is a further object of the present invention to provide an improved drain tube for window assemblies.

It is yet another object of the present invention to provide a drain tube of simple and inexpensive construction, such as a two piece structure.

It is still another object of the present invention to provide a drain tube which can be easily installed in the field into existing window assemblies and from the outside.

It is still a further object of the present invention to provide a drain tube having a removable closure.

It is yet a further object of the present invention to provide a drain tube having a straight (linear) structure.

Still other objects, features and attendant advantages of the present invention will become apparent to those skilled in the art from a reading of the following detailed description of embodiments constructed in accordance therewith, taken in conjunction with the accompanying draining, wherein:

DESCRIPTION OF PREFERRED EMBODIMENTS

Figure 1:
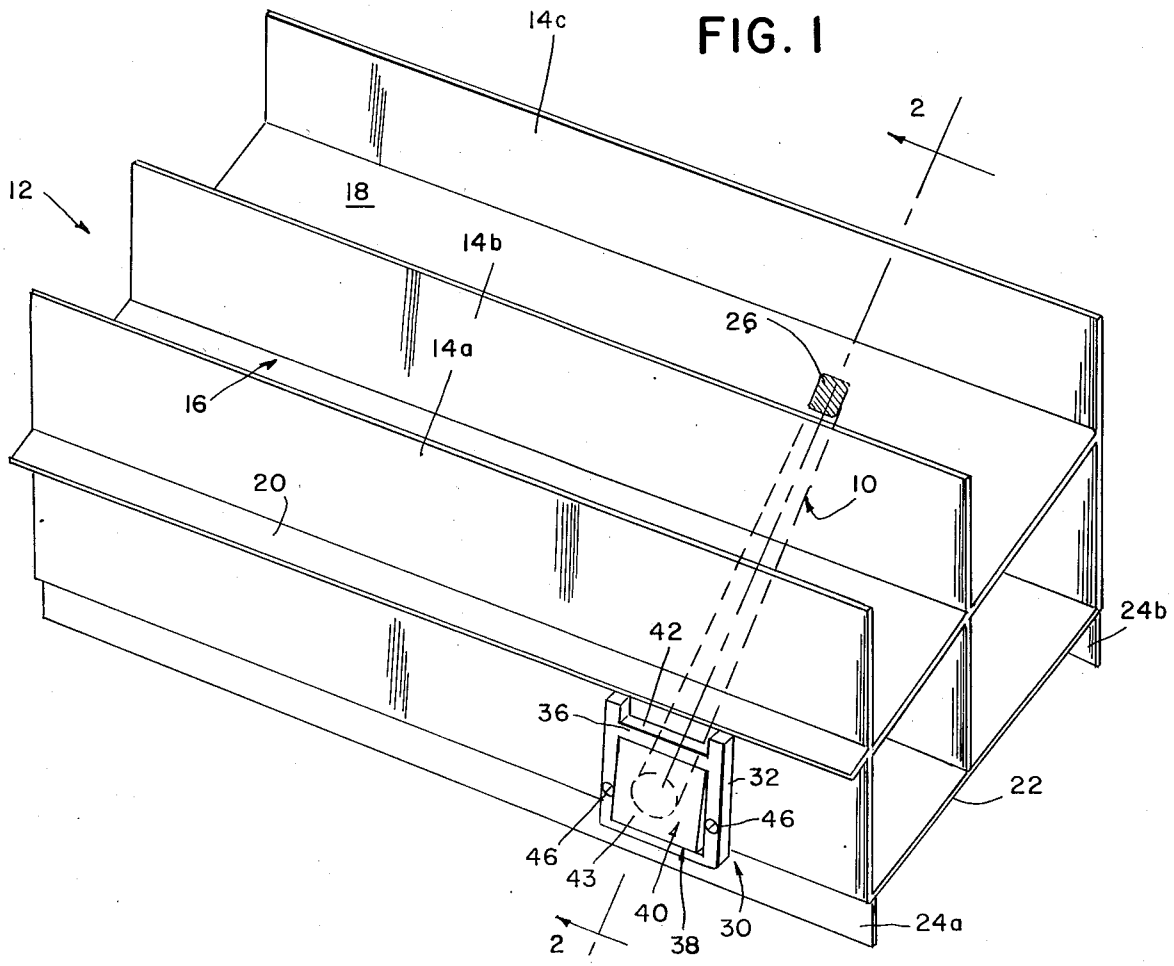
FIG. 1 is a perspective view of a straight drain tube in accordance with the present invention installed in an existing window sill assembly.
Figure 2:
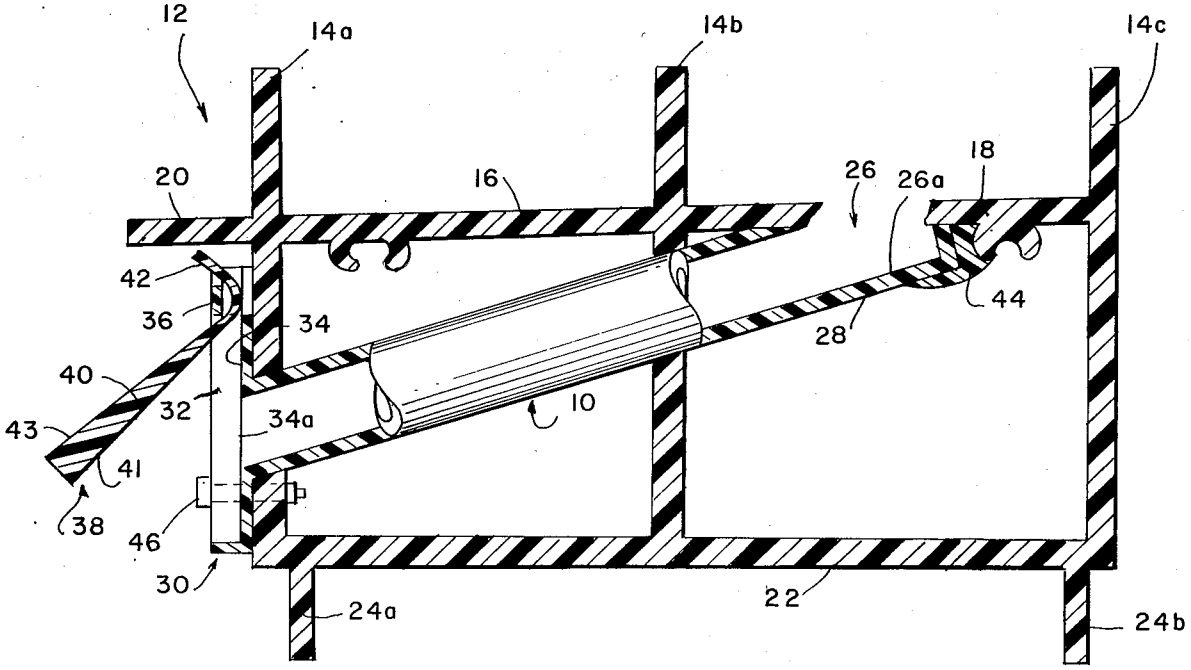
FIG. 2 is a cross-sectional view of the straight drain tube installed in an existing window sill assembly taken along the line 2—2 in FIG. 1.

A presently preferred embodiment of the present invention is illustrated in FIGS. 1 and 2 of the drawings, and comprises the combination of a straight, i.e. linear, drain tube 10 and a closure of baffle 38 removably secured at its outlet end, the tube and closure being adapted for installation in an existing conventional extruded window sill assembly 12.

The window sill 12, which can be extruded of any suitable material such as vinyl or aluminum, includes three spaced apart parallel vertically extending walls 14*a*, 14*b*, 14*c* and two spaced generally horizontal walls 20,22, the wall 20 being somewhat inclined as is conventional so that wall 20 at the front intersects wall 14*a* at a lower height than at its back end where it intersects wall 14*c*. The sill assembly thus includes two longitudinal channels 16,18 extending the width of the window frame, the channel 16 being formed between walls 14*a* and 14*b* at a lower level and channel 18 being formed between walls 14*b* and 14*c* at a higher level. Channels 16 and 18 provide regions for receiving conventional window sashes (not shown), it being understood that the present invention is applicable to both side sliding windows and up-and-down sliding windows. The sill assembly 12 may also include vertically extending projections 24*a*, 24*b* which extend parallel to one another along the entire longitudinal length of wall 22 and which provide a shielding base for installation of the sill assembly.

The straight drain tube 10 includes a linear conduit 28 having a moisture inlet end 26*a* and a moisture outlet end 34*a*, the inlet end of receiving and collecting moisture which may build up within the channel 18 due to ambient weather conditions, and the outlet end for dispensing the condensed moisture or rain water therefrom. The tube's outlet end 34*a* is provided with an integrally formed closure face 30 which allows for the fastening of a removable closure or baffle 38. It should be understood that the tube 28 and the closure face 30 are a single unitary piece integrally molded together, while closure 38 is a separate distinct piece removably secured to the closure face 30.

The tube 28, the closure face 30, and the closure 38 are all preferably made of a rigid or semi-rigid material, preferably plastic, e.g. nylon, vinyl, polyolefin, etc., which permits the entire tube assembly to be inserted into the sill assembly through installation holes drilled on site, without deformation or damage to the drain tube assembly. One significant advantage of the invention is that these holes can be drilled straight through from the outside, at an angle, first through the wall 14*a*, then wall 14*b* and finally the bottom of the channel 18.

The closure face 30 has a generally rectangular planar configuration and includes a frame 32 for the passage of screws 46,46 therethrough, thereby providing mounting means for securing the closure face 30 adjacent the lower part of the front face of the sill wall 14*a*. Within the frame 32 is provided a substantially thinner rectangular closure seat 34 for receiving the back face 41 of the baffle 38. The tube outlet end 34*a* lies along the face of the closures seat 34; in other words, the outlet of the tube 28 forms a central circular opening in the closure seat 34. In addition the closure face 30 is provided at its upper end with a horizontal bar 36 to allow the closure or baffle 38 to be removably secured thereto, the closure 38 being hooked and pivoted about the bar 36.

As can best be seen in FIG. 2, the closure 38 is generally L-shaped in configuration including a horizontal leg 42 and a vertical tapered leg 40, the leg 40 being progressively thicker in cross-section as it approaches its end farthest away from the horizontal leg 42. In the closed position of the flap valve, the back face 41 of the tapered vertical leg 40 is vertically disposed and consequently its front face 43 is inclined away from the vertical. Due to the weight provided by the excess tapered material, i.e. gravity tending to pull the baffle 38 downwardly so that its centerline would be vertically disposed, the back face 41 of the closure baffle 38 is urged flush against the closure seat 34.

Figure 3:
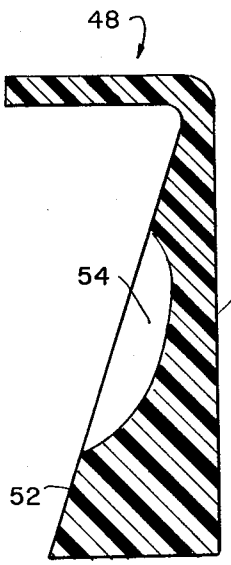
FIG. 3 is a cross-sectional view of an alternate embodiment of the closure/baffle employed in the present invention.

In an alternate embodiment as shown in FIG. 3, the closure baffle 48 includes a concavely shaped region or depression 54 in the front face 52 of its vertical tapered leg 50 to prevent ambient wind or the like from opening or moving the closure baffle 48 from the closure face 30. The smooth depression 54 functions like the wing of an airplane; air flowing over it parallel to the plane of the window serves to further bias the baffle 48 to its closed position.

Installation of the drain tube within existing window sill assemblies, whether side sliding or up-and-down sliding window sills, may be achieved by drilling a hole through wall 14*a*, 14*b* and 18 so as to enable tube 28 to be inserted between walls 20 and 22 in a tilted fashion as shown in FIG. 2. The screws 46 are driven home, the baffle hooked onto the bar 36, and the installation is thus completed.

It should be understood that the drain tube may of course be installed in either channel of the sill assembly as long as the tube can be lodged in a slanted fashion and long as the tube's inlet end is in contact with an aperture 26 in any location on wall 20 within the channel 18. It should be further understood that the drain tube could be of various lengths and diameters to accommodate sills of various dimensions and thicknesses. It may also be desirable to apply an adhesive or sealant 44 to the tube's inlet end to facilitate a more secure mounting of the tube within the window sill assembly.

It will be obvious to those skilled in the art that various other changes and modifications may be made without departing from the scope of the invention and the invention is not to be considered limited to what is shown in the drawings and described in the specifications.

What is claimed is:

1. A window assembly, comprising an extruded frame serving as a window sill and having at least one vertically extending wall defining the exterior of said sill, and at least one generally horizontal wall for defining the upper surface of the sill for contact with a movable window;

a straight drain tube having an inlet end and an outlet end, said outlet end having a closure face integrally formed therewith;

a flap-like closure removably and pivotably secured to said closure face of said drain tube, said flap-like closure including a horizontal leg and a substantially longer vertical leg, said vertical leg having a tapered cross-section whereby said vertical leg becomes progressively thicker in cross-section as it approaches its end farthest from said horizontal leg, said vertical leg including a concave depression in its exterior face;

said drain tube being positionally mounted in said extruded frame at an angle from the horizontal with its inlet end being generally flush with a hole in said generally horizontal wall, said drain tube extending through an opening in said vertically extending wall and with said closure face being mounted to the exterior face of said vertically extending wall at a lower level than said inlet end.

2. A window assembly in accordance with claim 1, wherein said closure face includes a relatively thick frame and a substantially thinner rectangular closure seat portion lying within said frame and having a size and shape generally complementary to said flap-like closure.

3. A window assembly in accordance with claim 2, wherein said frame includes a horizontal bar at its upper end for receiving and removably securing said flap-like closure, said flap-like closure being pivotable about said bar.

4. A window assembly in accordance with claim 1, wherein said generally horizontal wall is slanted downwardly in the direction of said vertical wall.

5. A window assembly in accordance with claim 1, wherein said closure face and said tube are integrally molded into a one-piece unitary structure.

6. A drain tube for use in conjunction with a window assembly, comprising:

a straight tube having an inlet end and an outlet end;

a closure face integrally formed to said outlet end and said closure face including a surrounding frame and a recessed closure seat portion substantially thinner than said surrounding frame;

a removable flap-like closure having means to pivotally mount said flap-like closure to said frame at the top thereof, said flap-like closure being tapered so as to be progressively thicker in cross-section as it approaches its bottom end and comprising a concave depression in its outer surface, the recessed closure seat portion and the flap-like closure being generally complementary in size and shape.

7. A drain tube in accordance with claim 6, wherein said closure face and said tube are integrally molded into a one piece unitary structure.

8. A drain tube according to claim 6, wherein said flap-like closure and said recessed closure seat are generally rectangular, said frame including a horizontal bar at its upper end; and said flap-like closure having a L-shaped configuration with said tapered structure forming a vertical leg and the other leg being horizontal and hookable about said horizontal bar, wherein said flap-like closure can be removable secured to said closure face upon insertion of said horizontal leg around said horizontal bar to enable said closure to pivot about said horizontal bar.

9. A window assembly, comprising:

an extruded frame serving as a window sill and having at least one vertically extending wall defining the exterior of said sill, and at least one generally horizontal wall for defining the upper surface of the sill for contact with a movable window;

a straight tube defining an axis and having an inlet end and an outer end;

a closure face lying generally in a plane and integrally formed to said inlet end of said straight tube, said closure face including a surrounding frame and a recessed closure seat portion substantially thinner than said surrounding frame, said surrounding frame having an upper end and a lower end, and said straight tube projecting from the plane of said closure face at an acute angle with respect to the upper end of said frame;

a removable flap-like closure and means to pivotally mount said flap-like closure to said frame at said upper end, said flap-like closure being tapered so as to be progressively thicker in cross-section as it approaches its bottom end, the recessed closure seat portion and the flap-like closure being generally complementary in size and shape;

said drain tube being positionally mounted in said extruded frame at an angle from the horizontal with its inlet end being generally flush with a hole in said generally horizontal wall, said drain tube extending through an opening in said vertically extending wall and with said closure face being mounted to the exterior face of said vertically extending wall at a lower level than said inlet end.

10. An assembly according to claim 9, wherein said flap-like closure and said recessed closure seat are generally rectangular, said frame including a horizontal bar at its upper end; and said flap-like closure having a L-shaped configuration with said tapered structure forming a vertical leg and the other leg being horizontal and hookable about said horizontal bar, wherein said flap-like closure can be removable secured to said closure face upon insertion of said horizontal leg around said horizontal bar to enable said closure to pivot about said horizontal bar.

11. An assembly in accordance with claim 9, wherein said closure face and said tube are integrally molded into a one piece unitary structure.

* * * * *